US005669081A

United States Patent [19]

Scherer et al.

[11] Patent Number: 5,669,081

[45] Date of Patent: Sep. 23, 1997

[54] SELF-LOCKING TOILET SEAT COVER

[75] Inventors: Craig S. Scherer, Wilmette; David C. Brown, Chicago; Michael C. Thuma, Desplaines, all of Ill.

[73] Assignee: BRK Brands, Inc., Aurora, Ill.

[21] Appl. No.: 672,446

[22] Filed: Jun. 28, 1996

[51] Int. Cl.[6] ..... A47K 13/00

[52] U.S. Cl. ..... 4/253; 4/242.1; 16/DIG. 32; 220/337

[58] Field of Search ..... 4/253, 234, 242.1, 4/243.1, 246.1, 661; 292/256, 145; 220/326, 334, 337; 16/DIG. 32; 312/215, 222; 24/324

[56] References Cited

U.S. PATENT DOCUMENTS

| | | | |
|---|---|---|---|
| D. 131,137 | 1/1942 | Baumann, Sr. . | |
| D. 169,271 | 4/1953 | McWaide . | |
| D. 180,264 | 5/1957 | Black . | |
| D. 185,771 | 7/1959 | Mills . | |
| D. 188,838 | 9/1960 | Johnson . | |
| D. 195,255 | 5/1963 | Elliott et al. . | |
| D. 223,263 | 4/1972 | Goldstein . | |
| D. 261,828 | 11/1981 | Nakao et al. . | |
| D. 266,634 | 10/1982 | Knoedler et al. . | |
| D. 284,690 | 7/1986 | Mandelbaum . | |
| D. 288,118 | 2/1987 | Boucher . | |
| D. 304,135 | 10/1989 | Mergenov . | |
| D. 309,091 | 7/1990 | Shepard . | |
| D. 320,528 | 10/1991 | Bernstein et al. . | |
| D. 332,529 | 1/1993 | Shuler . | |
| D. 336,330 | 6/1993 | Harshman et al. | 4/253 |
| D. 341,207 | 11/1993 | Freese et al. . | |
| D. 346,206 | 4/1994 | Crossley et al. . | |
| D. 372,965 | 8/1996 | Villeneuve . | |
| 392,297 | 11/1888 | White . | |
| 913,310 | 2/1909 | Schreiber . | |
| 1,413,081 | 4/1922 | Watson | 292/256 |
| 1,428,039 | 9/1922 | Kratz . | |
| 1,961,904 | 6/1934 | Meyer . | |
| 2,162,480 | 6/1939 | Forbes | 292/256 |
| 2,229,411 | 1/1941 | Hughes . | |
| 2,237,076 | 4/1941 | Kenney et al. . | |
| 2,246,108 | 6/1941 | Sermon . | |
| 2,285,900 | 6/1942 | Chapman . | |
| 2,468,742 | 5/1949 | Faulhaber . | |
| 2,503,938 | 4/1950 | Davis, Jr. . | |
| 2,562,628 | 7/1951 | McPeake, Jr. . | |
| 2,563,076 | 8/1951 | Schreckengost . | |
| 2,645,781 | 7/1953 | Mover . | |
| 2,696,439 | 1/1954 | Bruckner . | |
| 2,697,478 | 5/1954 | McKinney . | |
| 2,985,889 | 5/1961 | Fain et al. . | |
| 3,022,518 | 2/1962 | Hayden . | |
| 3,024,472 | 3/1962 | Hardenbrook . | |
| 3,031,229 | 4/1962 | Symbaluk . | |
| 3,048,854 | 8/1962 | Miller | 4/253 |
| 3,056,972 | 10/1962 | Miller | 4/253 |
| 3,086,222 | 4/1963 | Hall et al. . | |
| 3,100,639 | 8/1963 | Bonewitz . | |
| 3,203,008 | 8/1965 | Murcott . | |
| 3,209,374 | 10/1965 | Walz . | |
| 3,245,717 | 4/1966 | Levy . | |
| 3,324,488 | 6/1967 | Schulz, Jr. . | |
| 3,341,004 | 9/1967 | Schell . | |

(List continued on next page.)

*Primary Examiner*—Henry J. Recla
*Assistant Examiner*—Charles R. Eloshway
*Attorney, Agent, or Firm*—Dressler, Rockey, Milnamow & Katz, Ltd.

[57] ABSTRACT

A lock for use with an associated toilet having a rim portion and a generally outwardly oriented, depending surface, and having a seat cover thereon includes a releasably engageable receiving member and locking member. The receiving member has a housing and a pivotably connected mounting member. The mounting member is mountable to the rim portion of the bowl on the depending surface thereof. The housing includes at least one lock receiving element therein. The releasably engageable locking member has an elongated cover retaining element and at least one biased locking element. The locking element includes a releasing member thereon for releasing the locking member from the lock receiving element.

9 Claims, 4 Drawing Sheets

U.S. PATENT DOCUMENTS 3,422,466 1/1969 Banoczi .
3,493,976 2/1970 Bakeer .
3,504,927 4/1970 Seki .
3,528,111 9/1970 Chou .
3,538,554 11/1970 Ford ..... 24/324
3,619,823 11/1971 Sackett .
3,718,365 2/1973 Gibson .
3,796,430 3/1974 Sudo .
3,995,331 12/1976 Fotre et al. .
4,145,771 3/1979 Khazin ..... 4/253
4,150,445 4/1979 Bailey .
4,226,467 10/1980 Boudreau .
4,266,306 5/1981 Lee .
4,296,504 10/1981 Lawson ..... 4/253
4,395,784 8/1983 Foster .
4,479,273 10/1984 Raden et al. .
4,502,167 3/1985 Porzelius ..... 4/253
4,524,470 6/1985 Grenell .
4,650,246 3/1987 Henriksson .
4,687,452 8/1987 Hull .
4,736,472 4/1988 Buckshaw et al. .
4,822,030 4/1989 Cone .
4,833,737 5/1989 Boucher et al. ..... 4/253
4,894,870 1/1990 Buckshaw et al. ..... 4/253
5,010,606 4/1991 Bernstein et al. .
5,094,505 3/1992 Nicholas .
5,158,460 10/1992 Bernstein et al. .
5,240,212 8/1993 Brodie .
5,259,096 11/1993 Grant ..... 24/324
5,321,859 6/1994 Buckshaw et al. .
5,369,819 12/1994 Capuano, Jr. .
5,425,149 6/1995 Crossley et al. .
5,435,016 7/1995 Smith et al. .

SELF-LOCKING TOILET SEAT COVER

FIELD OF THE INVENTION

This invention relates to locks for toilet seat covers. More particularly, the invention relates to self-locking, multiple element locks for toilet seat covers which are usable with most toilet seat and bowl configurations.

BACKGROUND OF THE INVENTION

Toilet seat covers are typically readily opened, providing easy access into the bowl of the toilet and the water therein. Often, chemicals are used to maintain the toilet clean and fresh or sanitary. Such chemicals may be hazardous to the health of persons or pets if the chemicals are ingested.

Toilets seat cover locks are well known. Such locks are used principally, to prevent children from unauthorized and unwanted access to the inside of the toilet and the water therein.

Known seat locks include a type which is hinged and is adapted to be installed at or along the hinge portion of the toilet seat cover. Typically, such locks reside at about the rear of the cover, between the cover and the toilet tank.

There are, however, a number of drawbacks to such locks. First, because the locks are installed as part of the cover or seat hinge, many people may consider the installation to be difficult, and may thus be discouraged from installing the locks. In addition, because of the placement of the lock between the cover and the toilet tank, the cover may not remain in an upright or open position, and may fall closed, when it is desired to leave the cover in the open position.

Another known type of lock includes a pivotable, hinged lock which is placed at or near the side of the toilet bowl. Typically, such a lock is held in place by clamping a portion of the lock to the inside of the bowl, possibly under the rim of the bowl. While such a lock may function well, it may also tend to interfere with toilet cleaning. Moreover, when this type of lock is released, the clamping portion may fall into the bowl of the toilet.

Accordingly, there continues to be a need for a toilet seat cover lock which is readily installed on the toilet, and which is easily engaged to lock the seat cover closed and disengaged to permit opening the seat cover. Preferably, such a seat cover lock will be configured so as to minimize interference with toilet cleaning.

SUMMARY OF THE INVENTION

A lock for use with an associated toilet having a rim portion and a generally outwardly oriented, depending surface, and including a seat cover thereon includes a releasably engageable receiving member and locking member.

The receiving member has a housing and a mounting member. In a preferred configuration, the mounting member is pivotably connected to the housing. The mounting member is mountable using an adhesive or suction cups for example, to an outer surface of the rim portion of the bowl on the depending surface thereof. The housing includes at least one lock receiving element therein.

The locking member is releasably engageable with the receiving member. The locking member has an elongated cover retaining element and at least one biased locking element. The locking element includes a releasing member thereon for releasing the locking member from the receiving member.

The locking member and receiving member may also include aligning portions to facilitate proper alignment locking and receiving members with one another.

When the locking member is engaged with the receiving member, the cover retaining element extends adjacent to the seat cover to retain the seat cover in a closed position on the toilet. Disengaging the locking member from the receiving member allows the seat cover to be opened. In a preferred configuration, the retaining element includes, for example, an adhesive layer or suction cups, to mount the retaining element to the seat cover.

Preferably, the receiving member includes two lock receiving elements and the locking member includes two locking elements. In this configuration, the locking elements are opposingly oriented. In a preferred embodiment, each of the locking element and receiving element pairs independently engage the locking member and receiving member with one another.

Other features and advantages of the present invention will be apparent from the following detailed description, the accompanying drawings, and the appended claims.

DETAILED DESCRIPTION OF THE PREFERRED EMBODIMENTS

Figure 1:
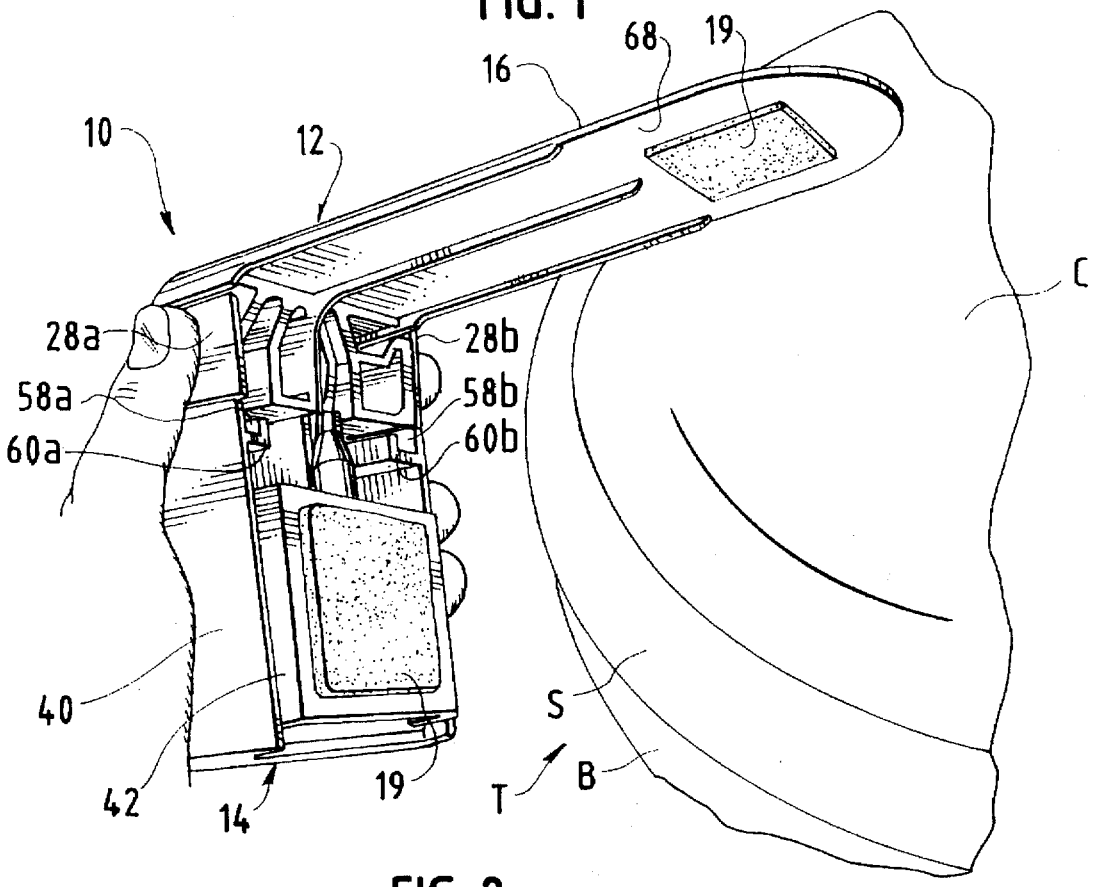
FIG. 1 is a perspective view of a toilet seat cover lock embodying the principles of the present invention, shown from the rear and illustrating the pivotable mounting member, and illustrated with the locking member and the lock receiving member engaged with one another.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
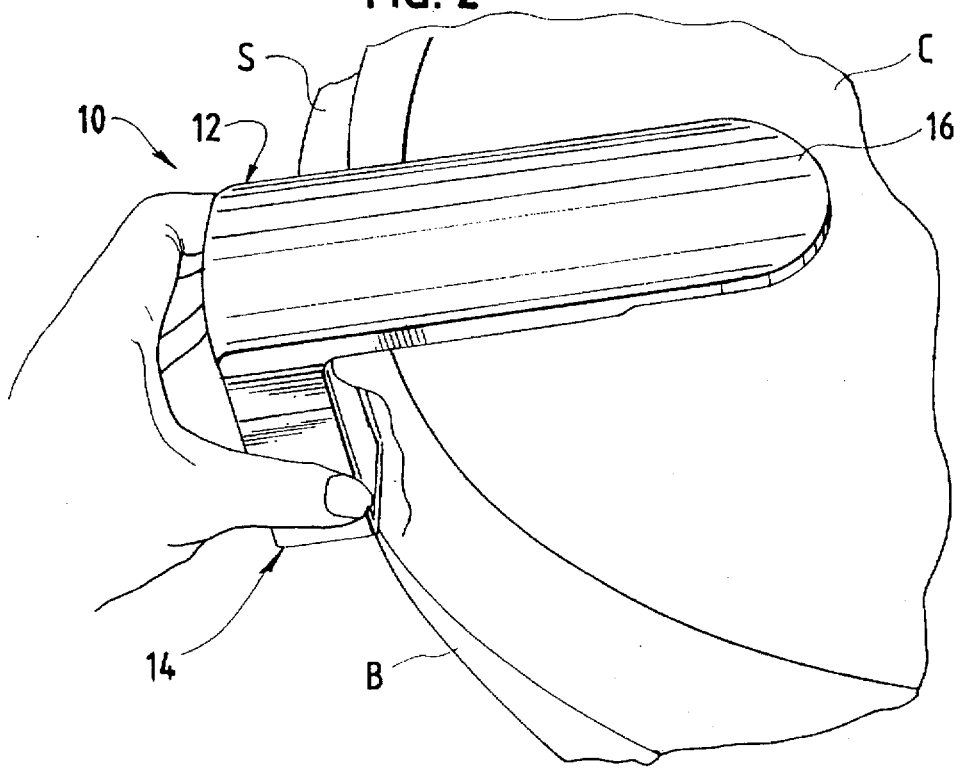
FIG. 2 is a top perspective view of the toilet seat cover lock of FIG. 1, shown with the mounting member mounted to an outer surface of an associated toilet bowl rim.
Figure 3:
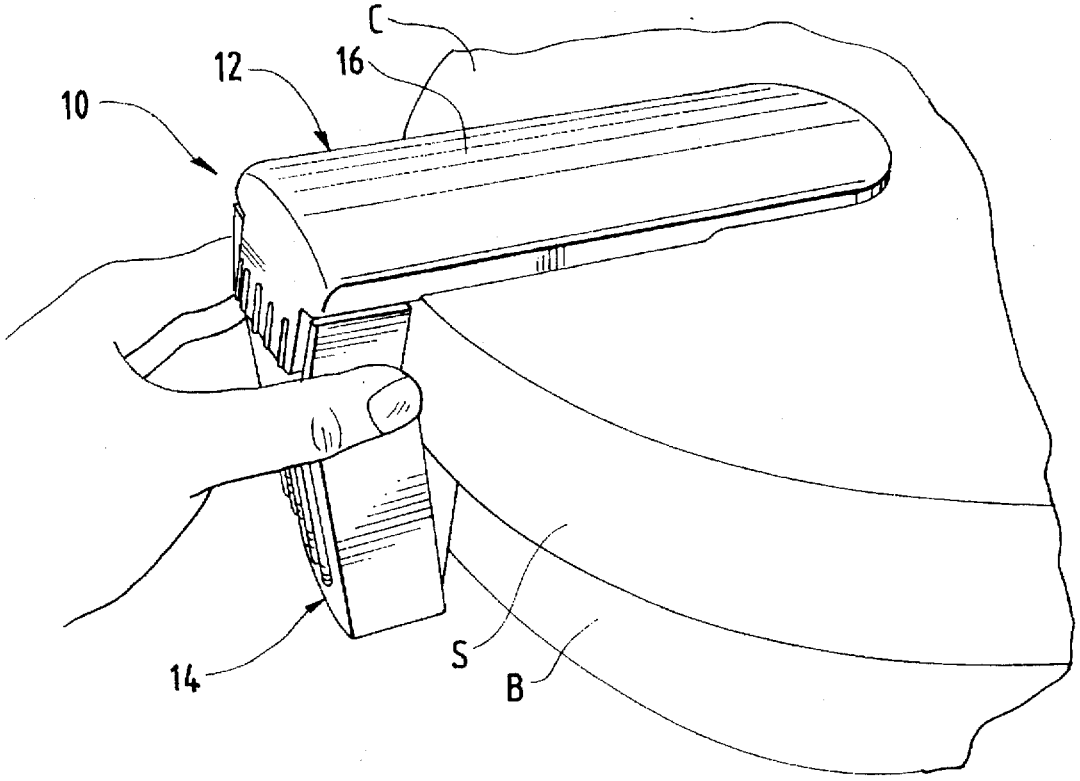
FIG. 3 is another perspective view of the seat cover lock of FIG. 1, illustrated with the biased releasing elements depressed, and the locking member partially disengaged from the lock receiving member.
Figure 4:
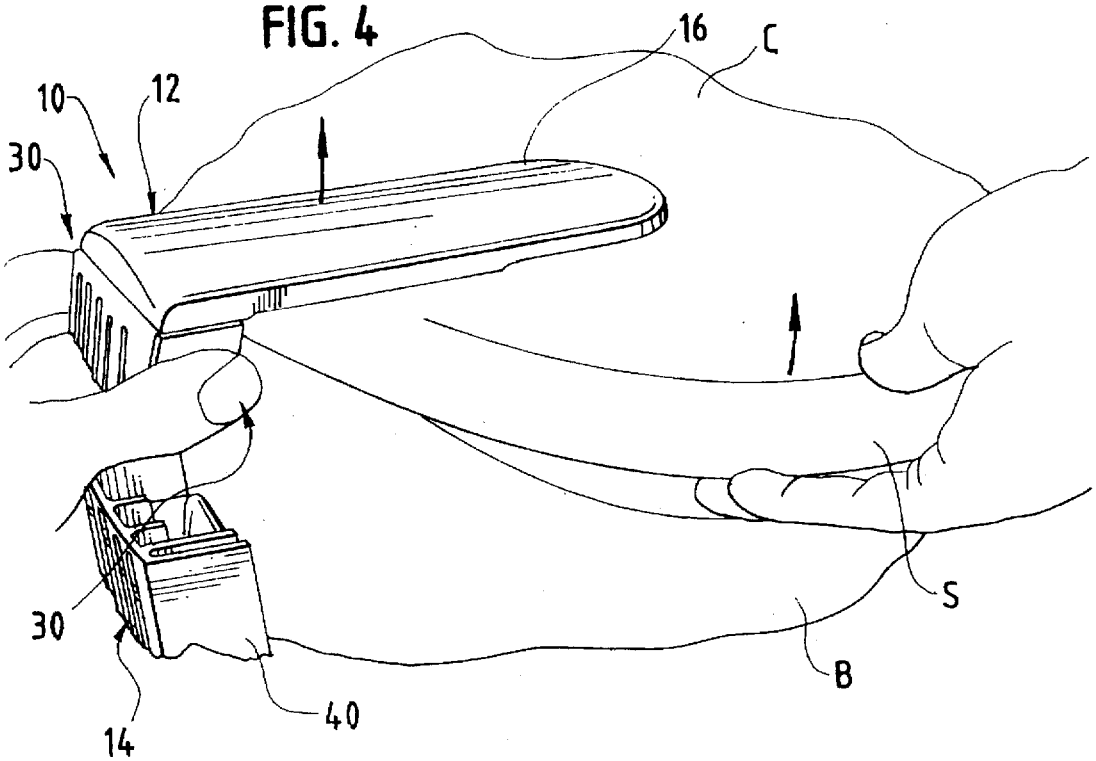
FIG. 4 is a view similar to FIG. 3, with the locking member fully disengaged from the receiving member, and illustrating the toilet seat cover being moved to the open position.

With reference now to the figures, and particularly to FIGS. 1–3, a toilet seat cover lock 10 illustrating the principles of the present invention is shown. The lock is illustrated with an associated toilet T having a seat S and cover C thereon.

The lock 10 includes, generally, a locking member 12 and a lock receiving member 14. The locking member 12 has an elongated cover retaining element 16 which extends over the seat cover C when the lock 10 is in place on the toilet T. When in place, the cover retaining element 16 prevents unauthorized, unwanted opening of the cover, and access to the inside of the toilet T and the water therein.

One or both of the members 12, 14 can be attached without brackets that extend into the toilet bowl and without screws. Removable attachments such as suction cups 17 can be used. Alternately, one or both of the members 12, 14 can be attached by a layer of adhesive 19.

Figure 8:
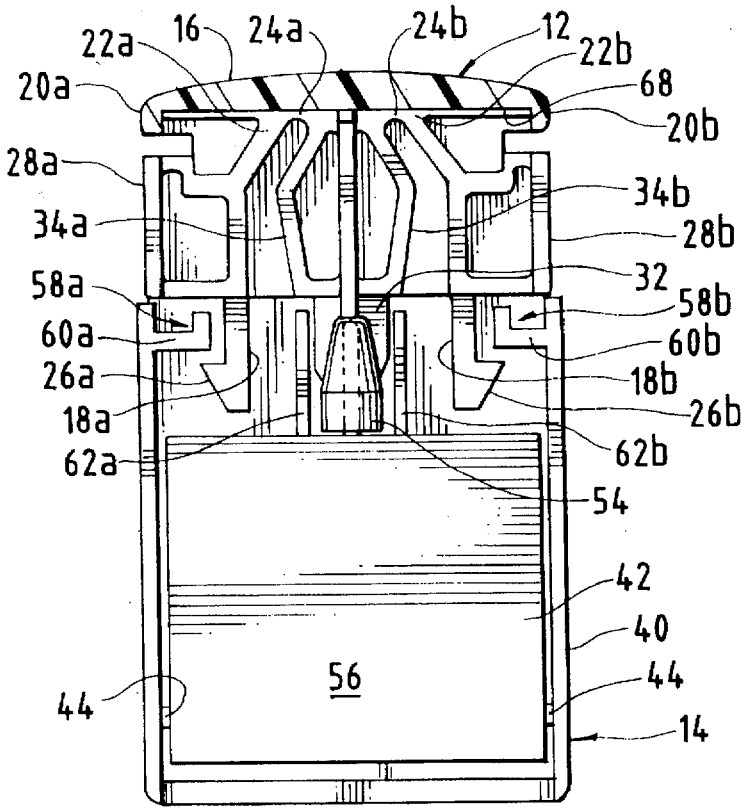
FIG. 8 is a view of the lock taken along line 8—8 of FIG. 5, showing the lock with the locking member and the lock receiving member engaged with one another.
Figure 9:
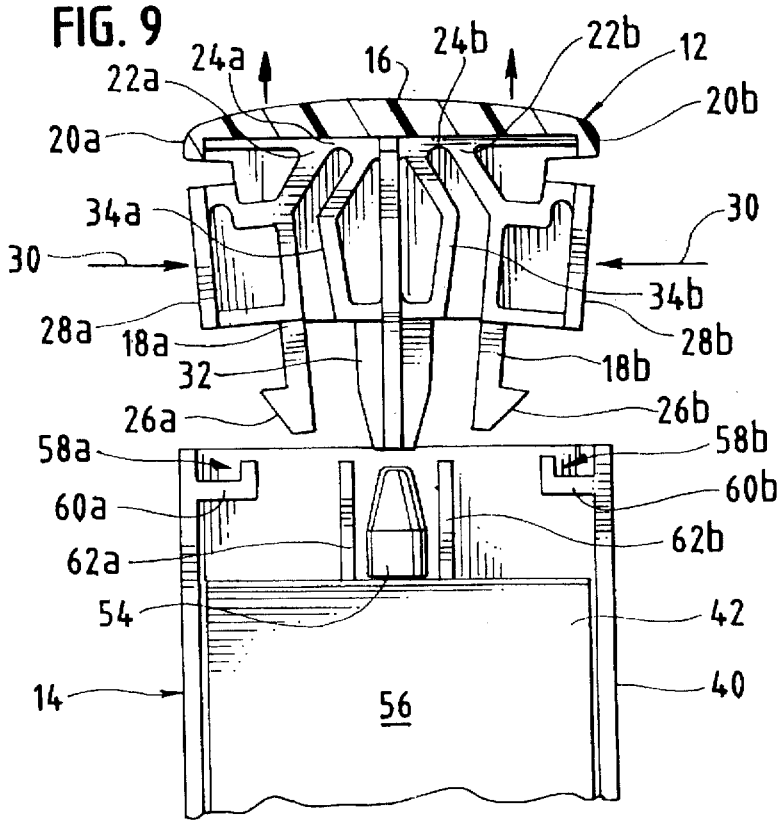
FIG. 9 is a view similar to FIG. 8, shown with the locking member and the lock receiving member disengaged from one another.

Referring now to FIGS. 8 and 9, the locking member 12 includes a pair of biased locking elements 18*a,b* which extend generally transversely from the cover retaining element 16. The locking elements 18*a,b* extend from the locking member 12 inwardly of the outer edges 20 thereof.

The junctures 22*a,b* of the locking elements 18*a,b* and the cover retaining element 16 define relatively flexible regions 24*a,b*. The flexible regions 24*a,b* provide a biasing characteristic for the locking elements 18*a,b*. The locking elements 18*a,b* are biased in the outward direction, away from one another.

In a preferred embodiment, the locking elements 18*a,b* include hook-like portions 26*a,b* which are adapted to engage the lock receiving member 14. Each locking element 18*a,b* may also include a releasing member 28*a,b* thereon.

The releasing members 28*a,b* may be formed as part of the locking elements 18*a,b* along a portion thereof intermediate the cover retaining element juncture 22*a,b* and the hook-like portions 26*a,b*. The releasing members 28*a,b* provide a region wherein pressure can be applied to the locking elements 18*a,b*, as illustrated by the arrows at 30, to move the elements 18*a,b* inward, against the bias. Inward movement of the elements 18*a,b* releases the hook-like portions 26*a,b* from the receiving member 14.

The locking member 12 may further include an aligning projection 32 which depends from the cover retaining element 16. The aligning projection 32 is adapted to be received in the receiving member 14 to facilitate proper alignment of the locking elements 28*a,b* with the receiving member 14. The projection 32 may further include stops 34*a,b* thereon to prevent over depressing the releasing members 28*a,b*.

Optionally, the retaining element 16 may include a layer of adhesive 19 on an inner surface 68 thereof. The adhesive 19 permits the locking member 12 to be mounted to the seat cover C. In this arrangement, the locking member 12 remains mounted to the seat cover C when the locking member 12 is disengaged from the receiving member 14. Alternately, the retaining element 16 may be mounted to the seat cover C by one or more suction cups 17 or the like.

The receiving member 14 is best seen in FIGS. 5–9. The receiving member 14 includes a housing 40, and a mounting member 42. In a preferred embodiment, the mounting member 42 is pivotably mounted to the housing 40.

Figure 7:
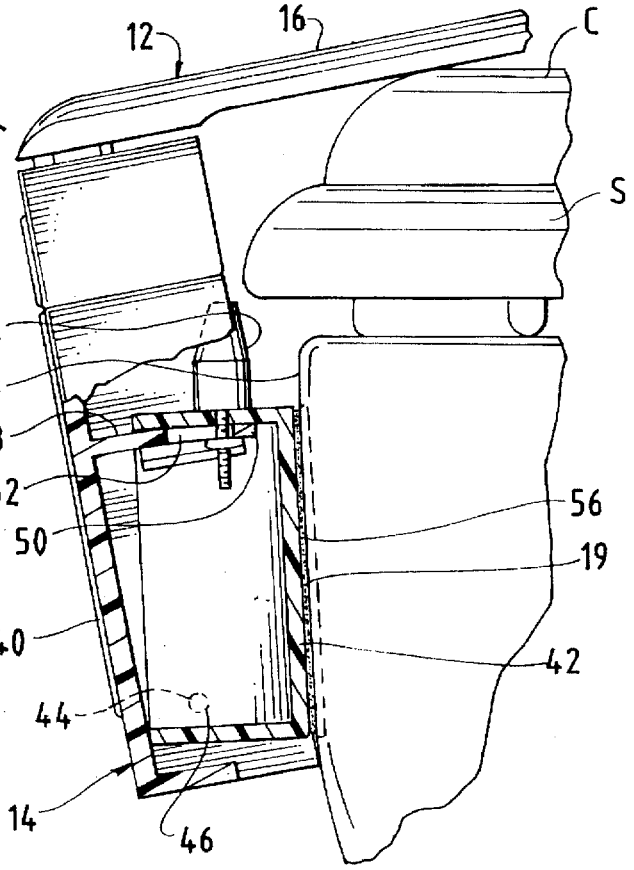
FIG. 7 is a view similar to FIG. 5, showing the toilet seat cover lock in use, mounted to the bowl of the associated toilet, with the mounting member having a layer of adhesive thereon for mounting to the toilet.

The mounting member 42 is pivotable about a pair of hinge pins 44 which extend inwardly of the housing 40 and engage a pair of hinge pin openings 46 in the mounting member 42. As shown in FIG. 7, the pivoting configuration permits the receiving member 14 to be mounted to toilet bowl rims R which may not be at right angles with the seat cover C. In addition, the pivotable configuration further permits the lock 10 to be used with toilet seat covers C which may extend relatively high above the toilet bowl rim R.

Figure 5:
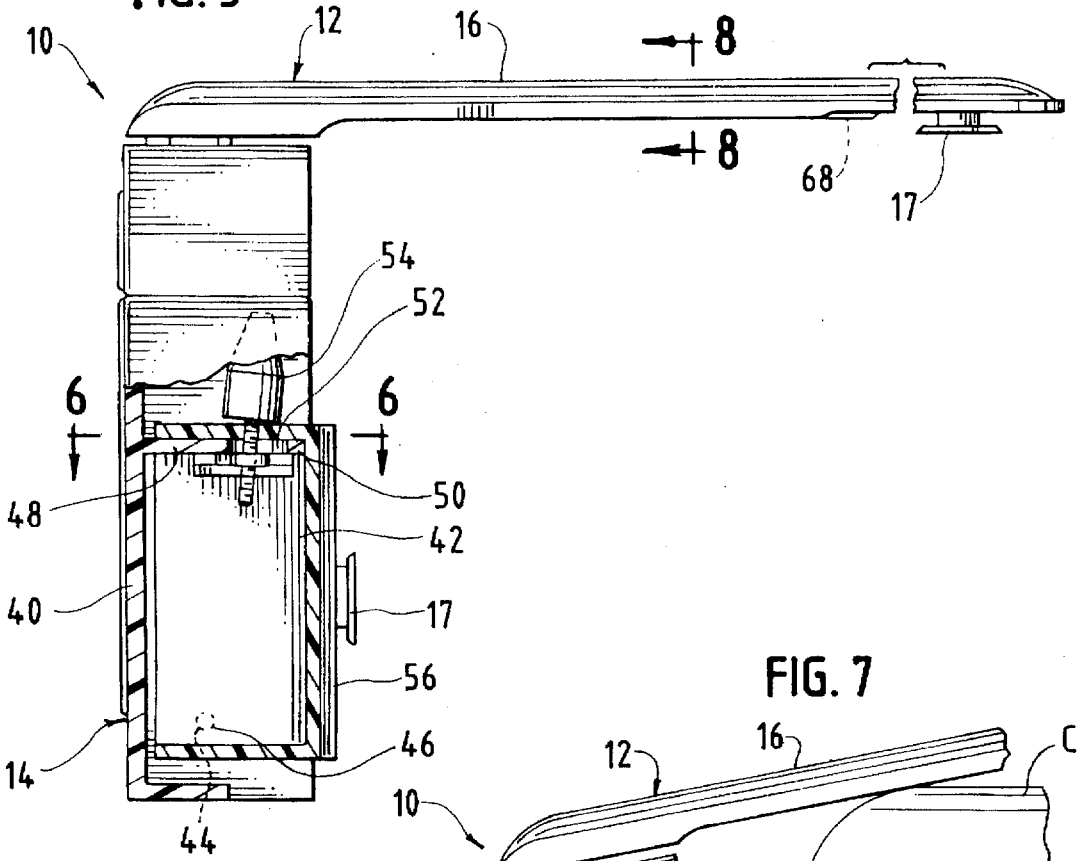
FIG. 5 is a side view, shown in partial cross-section, of the toilet seat cover lock of FIG. 1, with the locking member and receiving member engaged with one another, and illustrated with optional suction cups thereon.
Figure 6:
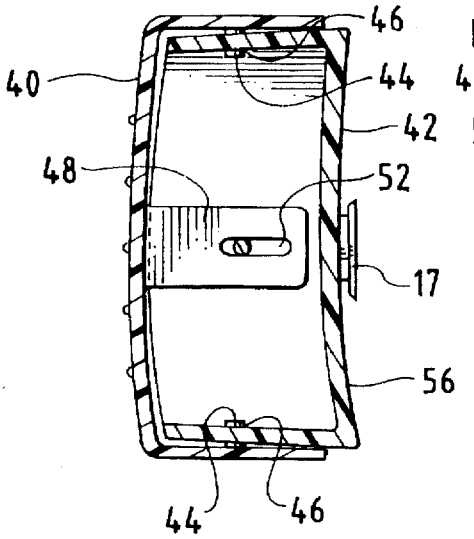
FIG. 6 is a cross-sectional view taken along line 6—6 of FIG. 5.

As best seen in FIGS. 5–7, the housing 40 includes a flange 48 which extends inwardly thereof and is positioned adjacent to the mounting member 42. The flange 48 has a threaded opening 50 therein. The mounting member 42 includes an elongated, slotted opening 52 therein which is adapted to align with the flange opening 50.

A threaded fastener, such as the illustrated hold-down bolt 54, extends through the slotted opening 52 and threadedly engages the threaded opening 50. The hold-down bolt 54 is configured to retain the mounting member 42 in place, at a selected angle, relative to the housing 40.

Once the proper angle of the mounting member 42 is achieved, the hold-down bolt 54 is threaded into the mounting member 42 to secure the housing 40 to the mounting member 42, and to securely retain the angle therebetween.

The mounting member 42 includes a mounting surface 56 which is adapted for mounting to an outer surface F of the toilet bowl rim R. The mounting surface 56 may carry, for example, an adhesive layer 19, to facilitate mounting to the toilet rim surface F. Alternately, the mounting surface may include one or more suction cups 17 to mount the receiving member 14 to the rim surface F.

The illustrated housing 40 further includes a pair of lock receiving elements 58*a,b* formed therein. As illustrated in FIG. 8, the receiving elements 58*a,b* are configured to engage the locking elements 18*a,b* of the locking member 12 when the locking member 12 is engaged with the receiving member 14.

In a preferred embodiment, the receiving elements 58*a,b* each include an inwardly extending lip or wall 60*a,b* which is adapted to engage its respective locking element 18*a,b*. Advantageously, in this configuration, each of the receiving element and locking element pairs 18*a*, 58*a* and 18*b*, 58*b*, independently engages with one another so that either pair alone will secure the locking member 12 and receiving member 14 to each other.

The receiving member 14 includes a pair of spaced apart aligning walls 62*a,b* which extend inwardly from the housing 40. The aligning walls 62*a,b* are configured to receive the aligning projection 32 therebetween to facilitate proper alignment of the locking member 12 and the receiving member 14 when they are engaged with one another.

In addition, the aligning projection 32 and walls 62*a,b* coact with one another to minimize or prevent transverse shifting of the locking and receiving members 12, 14 relative to each other. This characteristic further enhances the independent locking feature of each of the locking element/receiving element pairs 18*a*, 58*a* and 18*b*, 58*b*.

In use, the receiving member 14 is first positioned on the toilet bowl rim outer surface F and secured thereto so that the cover retaining element 16 extends over at least a portion of the seat cover C and retains the cover C closed. The angle between the mounting member 42 and the housing 40 is adjusted accordingly, and the hold-down bolt 54 is tightened to retain the angle between the mounting member 42 and the housing 40.

With the seat cover C closed, the locking member 12 is aligned with, and engaged with, the receiving member 14 by inserting the locking elements 18*a,b* into the receiving member 14 until the locking elements 18*a,b* engage the receiving elements 58*a,b*. Alignment of the members is facilitated by aligning the projection 32 between the aligning walls 62*a,b*.

With the seat cover C closed, the adhesive 19 or suction cups 17 can be used to mount the locking member 12 to the seat cover C.

To open the seat cover C, the releasing members 28*a,b* are depressed or urged inwardly to disengage the locking elements 18*a,b* from the receiving elements 58*a,b*. The locking member 12 is disengaged from the receiving member 14 as the seat cover C is being opened.

With the adhesive 19 or suction cups 17 used to mount the locking member 12 to the seat cover C, the locking member 12 remains in place on the seat cover C. To resecure the toilet seat, it is only necessary to close the cover C. The members 12, 14 will automatically lock together keeping the toilet seat cover C closed.

It will be recognized by those skilled in the art that the location of the locking and receiving elements 18*a,b* and 58*a,b*, may be reversed without departing from the nature and scope of the present invention. That is, the locking elements 18*a,b* can be positioned on the receiving member 14 and the receiving elements 58*a,b* can be positioned on the locking member 12. Such an arrangement is within the scope of the present invention. Other forms of attachment instead of adhesive or suction cups could be used without departing from the spirit and scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intend to cover by the appended claims all such modifications as fall within the scope of the claims.

What is claimed is:

1. A lock attachable to a toilet bowl and an associated seat cover for locking the seat cover to the bowl, the lock comprising:

a first housing and a separate second housing wherein each of the housings is substantially rigid and carries a latching portion, and wherein each of the housings carries an attachment element adapted to attach the respective housing to one of a portion of the bowl and a surface of an adjacent portion of the seat cover whereby the latching portions of the two housings are located adjacent to one another when the seat cover is moved to a position adjacent to and effective to close the bowl;

first and second releasably engagable latch elements wherein the first latch element is carried by the first housing at the respective latching portion and the second latch element is carried by the second housing at the respective latching portion with the two latch elements adapted to lockingly engage one another when the housings are located adjacent to one another thereby holding the seat cover closed against the bowl; and a two-part release mechanism carried by one of the housings and coupled by at least one unlatching member to the respective latch element wherein the two parts of the release mechanism are both movable toward one another and in response to relative movement of both parts toward one another the at least one unlatching member disengages the latch elements from one another enabling the seat cover to be opened.

2. A lock as in claim 1 wherein the two parts of the release mechanism move toward one another in response to the housings moving adjacent to one another.

3. A lock as in claim 1 which includes a biasing element to retain the two parts of the release mechanism spaced apart from one another at least when said first and second latch elements are engaged.

4. A lock as in claim 3 wherein the first and second latch elements slidably, and lockingly engage one another in response to the seat cover moving to the position adjacent to the bowl.

5. A lock as in claim 1 wherein the attachment elements each carry an adhesive layer for attaching the respective housing to the bowl or the cover.

6. A lock as in claim 5 wherein the two parts of the release mechanism each include a planar surface, wherein the surfaces lie in a parallel planes and wherein the parallel planes are substantially perpendicular to a plane formed by the surface of the seat cover when said seat cover is in said position adjacent the bowl.

7. A lock as in claim 1 wherein the first latch element includes two spaced apart locking hooks adapted to engage the second latch element.

8. A lock as in claim 7 wherein the second latch element includes first and second spaced apart flanges which engage the locking hooks when the seat cover is closed.

9. A lock mechanism as in claim 8 wherein each part of the two part release mechanism includes a biasing element and an unlatching tab, with the biasing element coupled to the housing and the unlatching tab and with the unlatching tab coupled to the unlatching member with the unlatching member coupled in turn to one of the locking hooks whereby as the unlatching tabs are moved toward one another, the locking hooks move away from the flanges thereby permitting the hooks to move past the flanges as the seat cover is moved away from the position adjacent to the bowl.

* * * * *